US008707659B2

(12) United States Patent
Ligon et al.

(10) Patent No.: US 8,707,659 B2
(45) **Date of Patent: *Apr. 29, 2014**

(54) METHOD OF AND APPARATUS FOR MANUFACTURE OF A SQUEEZABLE FLEXIBLE PACKAGE

(75) Inventors: Robert J. Ligon, Frankfort, IL (US); Trevor A. Ramalho, Oshawa (CA)

(73) Assignee: New Beginnings Contract Packaging LLC, West Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/399,360

(22) Filed: Feb. 17, 2012

(65) Prior Publication Data

US 2012/0144780 A1 Jun. 14, 2012

Related U.S. Application Data

(60) Continuation of application No. 13/039,669, filed on Mar. 3, 2011, now Pat. No. 8,117,805, which is a division of application No. 12/166,888, filed on Jul. 2, 2008, now Pat. No. 7,908,829.

(51) Int. Cl.

| | |
|---|---|
| ***B65B 9/08*** | (2012.01) |
| ***B65B 3/02*** | (2006.01) |
| ***B65B 31/04*** | (2006.01) |
| *B65B 9/093* | (2012.01) |

(52) U.S. Cl.

CPC ... *B65B 9/08* (2013.01); *B65B 3/02* (2013.01); *B65B 31/042* (2013.01); *B65B 9/093* (2013.01)

USPC ..... 53/433; 53/450; 53/455; 53/511; 53/548; 53/562

(58) Field of Classification Search

CPC ..... B65B 3/02; B65B 9/08; B65B 9/093

USPC ..... 53/433, 434, 450, 455, 459, 492, 511, 53/512, 548, 550, 562, 568, 386.1

IPC ..... B65B 9/08

See application file for complete search history.

(56) References Cited

U.S. PATENT DOCUMENTS

| | | | | |
|---|---|---|---|---|
| 2,649,671 | A * | 8/1953 | Bartelt | 53/433 |
| 2,718,105 | A * | 9/1955 | Ferguson et al. | 53/548 |
| 3,182,430 | A * | 5/1965 | Hoeppner | 53/455 |
| 3,319,539 | A * | 5/1967 | Johnson et al. | 53/455 |

(Continued)

*Primary Examiner* — Stephen F Gerrity

(74) *Attorney, Agent, or Firm* — Fitch, Even, Tabin & Flannery LLP

(57) ABSTRACT

A method and apparatus for manufacturing a non-rectilinear flexible package comprising an in-line process including application and selective sealing of a semi-rigid strip to an inner wall of the package and further including a dual-stage die-cutting technique to remove and cut a non-linear shape into a formed web of film. The semi-rigid strip is sealed to one interior wall of the package but not the other to provide a reinforced opening to the package through which a material can be dispensed. Additionally, the dual stage die-cutting method comprises first cutting and removing a portion of the web material prior to filling the package and again cutting and removing a portion of the web material after filling, resulting in a package having a narrowed neck adjacent the closed reinforced opening at an upper portion of the package and a body of the package that is tapered towards the reinforced opening.

12 Claims, 5 Drawing Sheets

(56) References Cited

U.S. PATENT DOCUMENTS

| | | | | | |
|---|---|---|---|---|---|
| 3,386,604 | A | * | 6/1968 | Fields | 53/455 |
| 3,423,902 | A | * | 1/1969 | Stroop | 53/511 |
| RE26,553 | E | * | 3/1969 | Nutting et al. | 53/562 |
| 3,599,388 | A | * | 8/1971 | Feingold | 53/455 |
| 3,618,286 | A | * | 11/1971 | Membrino | 53/459 |
| 3,708,952 | A | * | 1/1973 | Schulze et al. | 53/512 |
| 3,813,845 | A | * | 6/1974 | Weikert | 53/469 |
| 3,871,157 | A | * | 3/1975 | Domke et al. | 53/512 |
| 3,935,993 | A | * | 2/1976 | Doyen et al. | 383/94 |
| 3,975,885 | A | * | 8/1976 | Carlisle | 53/452 |
| 4,021,283 | A | * | 5/1977 | Weikert | 53/434 |
| 4,078,356 | A | * | 3/1978 | Gallo et al. | 53/433 |
| 4,216,639 | A | * | 8/1980 | Gautier | 53/455 |
| 4,229,928 | A | * | 10/1980 | Munchinger et al. | 53/459 |
| 4,384,440 | A | * | 5/1983 | Ohlsson | 53/412 |
| 4,512,136 | A | * | 4/1985 | Christine | 53/455 |
| 4,631,901 | A | * | 12/1986 | Chung et al. | 53/455 |
| 5,005,734 | A | * | 4/1991 | Van Gordon et al. | 222/107 |
| 5,080,643 | A | * | 1/1992 | Mitchell et al. | 493/195 |
| 5,181,365 | A | * | 1/1993 | Garvey et al. | 53/455 |
| 5,353,573 | A | * | 10/1994 | Durrant | 53/455 |
| 6,148,588 | A | * | 11/2000 | Thomas et al. | 53/455 |
| 6,178,724 | B1 | * | 1/2001 | Tobolka | 53/511 |
| 6,212,859 | B1 | * | 4/2001 | Bielik, Jr. et al. | 53/455 |
| 6,216,424 | B1 | * | 4/2001 | Yoshida | 53/455 |
| 6,478,190 | B2 | * | 11/2002 | Kuge et al. | 222/107 |
| 6,688,080 | B2 | * | 2/2004 | Kinigakis et al. | 53/412 |
| 6,729,107 | B2 | * | 5/2004 | Heimann et al. | 53/455 |
| 7,908,829 | B2 | * | 3/2011 | Ligon et al. | 53/562 |
| 8,117,805 | B2 | * | 2/2012 | Ligon et al. | 53/433 |
| 2001/0037627 | A1 | * | 11/2001 | Hausslein | 53/455 |
| 2009/0304875 | A1 | * | 12/2009 | Zerfas et al. | 426/122 |
| 2010/0139219 | A1 | * | 6/2010 | Fitzgerald, IV | 53/468 |

* cited by examiner

METHOD OF AND APPARATUS FOR MANUFACTURE OF A SQUEEZABLE FLEXIBLE PACKAGE

CROSS REFERENCE TO RELATED APPLICATION

This application is a continuation application of application Ser. No. 13/039,669 filed Mar. 3, 2011 and issued as U.S. Pat. No. 8,117,805 on Feb. 21, 2012, which is a divisional of application Ser. No. 12/166,888 filed Jul. 2, 2008 and issued as U.S. Pat. No. 7,908,829 on Mar. 22, 2011, the contents of which are incorporated herein by reference in their entirety.

FIELD

The present disclosure relates generally to a method of manufacture for a squeezable flexible package and, more specifically, to a method of manufacture that includes forming the package having a reinforced opening and tapered towards the opening, filling it and cutting it using a two-stage die cutting technique in-line on a single packaging machine.

BACKGROUND

Most standard-shaped flexible packages can be manufactured on a single continuous or intermittent in-line process to mass produce the packages and to automate the filling of the packages, such as is described in U.S. Pat. No. 4,216,639 issued to Gautier. The in-line process, however, typically requires a simple package design in order to operate in a relatively continuous or intermittent fashion. For instance, most automated processes comprise a form, fill and seal operation which ends in a cutting step to separate the formed, filled and sealed sections along a web of film into their individual packages. The flexible packages are made out of the web material or film, which is provided on a roll, such that the packages are formed on the web of film first as connected packages that are later singulated from one another into individual packages. The packages typically have a basic shape that can be easily formed with standard shaped sealing bars, such as a rectilinear package.

The package forming process typically comprises applying one or two pairs of sealing bars to form side seals of a package within the web of film, thus providing for interconnected packages. As the side seals are formed, the top of the interconnected package is left open to form an opening through which a product can be passed into an interior section of the interconnected package. The bottom edge of the package may be a fold, such as when one web of film is folded in half. The package is then filled through the opening once the side seals are formed into the web of film. Once filled, the top opening of the package can be sealed to close the interior of the package.

Once the interconnected package is sealed closed, it can then be cut and separated into individual packages. Alternatively, the package may be separated from the web and then filled and sealed. The final cutting step is often a simple horizontal or vertical cut, depending on how the package is oriented to fill. Furthermore, the final cut is often a linear cut, such that the resulting package is often a square or rectangular shaped package. Therefore, most common processes for making packages comprise utilizing horizontal or vertical sealing bars where relatively linear edge seals are desired, followed by filling and then a final sealing step. Typically, die-cutting steps are not included. Alternatively, a punch or die assembly could be used to die cut an irregular non-linear shaped edge where the opposite edge is a straight, linear edge. The opposite edge of the non-linear cut edge needs to be linear so that the die cut can be registered to the straight, linear edge. Thus, in order to die cut a non-linear edge, a linear opposite edge is typically required.

If a different shaped package is desired, such as a package that is not rectilinear, the non-conventional shape can be formed by employing cutting the package into its shape. For example, U.S. Pat. No. 3,975,885 issued to Carlisle, discloses forming containers having spouts with a rounded bottom, where the filled containers resemble a pillow-like pouch. The process discloses sealing a strip of thermoplastic to form and shape the pouch and to partially cut it out from the strip of film, while advancing the partially formed pouch in a flat, horizontal orientation. In fact, the cut portion of the pouch still remains adjacent the strip of film from which it was cut, not having been removed from it. After filling, a second seal and cut is made to separate the spouts from the strip of film. The die-cutting assemblies employed for cutting comprises both a die for making seams or seals and for "parting" or separating the pouches from the strip. Therefore, the die assembly performs more of a separation function than a die-cutting or stamping function, such as to stamp out or remove a cut piece from the strip of film. Thus, the cutting step is kept merely to that of separating pouches into simple shapes rather than die-cutting and removing complex shapes. Furthermore, the die assemblies have a combination sealing and cutting step, thus not allowing for the strip to cool between sealing and cutting.

SUMMARY

A method of manufacturing a squeezable flexible package is provided comprising an in-line process that has a dual-stage die-cutting technique and includes application of an interior facing semi-rigid strip to only one side of the package to form, fill, seal and die-cut the package on a single machine. The method of manufacture includes application of an interior facing semi-rigid strip that is sealed to one wall of the package but not the other, adjacent what will be a reinforced opening. Furthermore, the package shape is die-cut from the web using a two-stage die-cutting technique, first die-cutting one section of the package and then another after filling to provide a squeezable package having a narrower upper section, adjacent the opening, than lower section, such that the package shape tapers towards the reinforced opening.

The method of manufacturing allows a non-conventional shaped package to be made on a single machine utilizing an in-line automated process. The addition of the semi-rigid strip provides a reinforced opening in the package upon dispensing the contents of the package when squeezing the package. In order to allow the contents to exit the interior of the package, the strip cannot be sealed on both sides such that it allows an opening or passageway to exist along one side, i.e., its unsealed side. As a result, the application of a metal buffer plate between the strip and one side of opposing walls of the package provides a barrier to sealing at that location, which forms a portion of the opening in the upper section of the package.

The method of manufacturing includes unwinding a web of film material and folding it such that it has a pair of opposing package walls, while relatively simultaneously unwinding a semi-rigid strip in a machine direction and positioning the strip between the opposing walls at an upper section. A metal buffer plate can be placed between a non-sealing surface side of the semi-rigid strip and an inner surface of one of the opposing walls, to separate one side of the opposing wall and the semi-rigid strip such that upon applying sealing bars over the area of the strip, the metal buffer plate interferes with the sealing of that area and allows the two to remain unattached. Three seals are made using sealing bars; an upper seal (as just discussed) that is made using a sealing bar which is applied over the web of film in the area of the semi-rigid strip, and two side seals made using two sets of side sealing bars to create the side non-linear seals between the opposing walls and thus defining a pouch-shaped outline in the web of film. The upper seal is formed only along substantially one side of the semi-rigid material and one of the opposing walls, such that the opposite side of the semi-rigid material, i.e., the non-sealing surface side, and the other opposing wall remain unsealed to each other and thus provide a reinforced opening therebetween for access to an interior section of the pouch.

After the side seals are made, a first die-cut is made. The first die-cut stamps out and removes a portion of a lower section of the pouch along sections of the side seals, while the upper section remains interconnected to adjacent pouches that are formed in the web material. Subsequently, the pouches can be singulated by cutting the upper sections to separate the interconnected pouches into individual pouches or packages. After the packages are separated, a gas flush can be applied to the interior of the package and the packages can then be filled through the opening. After filling, the upper section of the package is sealed by applying a pair of sealing bars, and can then be cut to the final shape by a second die-cut that cuts and removes the cut section of film. The final tapered shape of the package that results has a narrower upper section than the lower section. The tapered shape directs the contents to the reinforced opening during squeezing, while the reinforced opening provides a semi-rigid boundary. The semi-rigid boundary can be preformed into a curved shape, such as by using a folded cardboard backing attached to the package.

DETAILED DESCRIPTION OF THE DRAWINGS

A method and apparatus for manufacturing a flexible package, such as a squeezable flexible package having a narrower upper portion than bottom portion, the method comprising two-stage die-cutting of a web of film to form the flexible package and sealing a semi-rigid strip along one side of the strip and one side of the package but not the other, is disclosed herein and illustrated in FIGS. 1-8. In particular, an in-line process for forming, filling, sealing, and die-cutting the packages is disclosed herein, where the packages have a reinforced opening and the package body can be tapered towards the reinforced opening.

Figure 1:
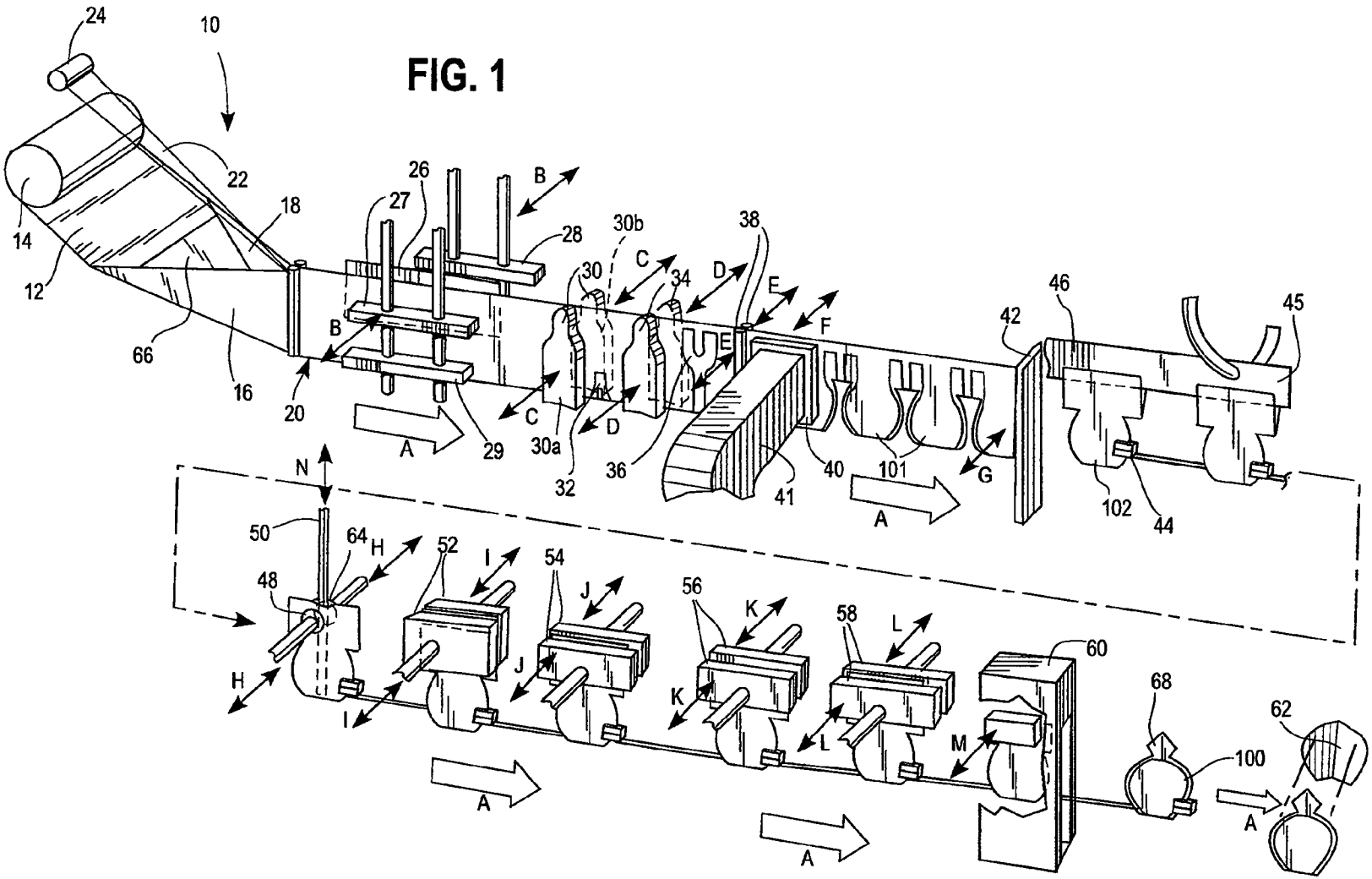
FIG. 1 is a perspective view of a process line for manufacturing a flexible package.

Turning to FIG. 1, a process line 10 is shown for forming, filling, sealing, and die-cutting a flexible package 100. In one aspect, a horizontal form, fill, seal machine may be used, such as is manufactured by Bartelt, and can be modified accordingly. A web of film 12 can be unwound from a roll of film 14 at a film unwind station and can be directed in a machine direction, as indicated by arrow A, along the process line 10. As the unwound web of film 12 is being advanced in a machine direction along the process line, it can advance towards a folding station for folding the web of film 12 into a pair of opposing walls 16 and 18. In one aspect a folding bar 66 may be used to fold the film 12, such as a triangular shaped folding plate. The opposing walls 16 and 18 of the web of film 12 that result when folded can have a front wall 16 and a back wall 18. Additionally, the unwound material can also be fed through various tension rollers (not shown), which can aid to control the unwind tension of the web of film 12. Furthermore, a power unwind station could also be installed for additional control of the web having, for example, a servo-driven edge guide with electronic eye for reading to automatically adjust the web edge for continuous and accurate registration of the folded web edges. One or both of the walls 16 and 18 can optionally have a printed surface on an outside surface of the wall; typically, the front wall 16 will have its outer surface printed with a label or other designation or logo. Additionally, at the folding station, the web of film 12 may be formed to include formation of a gusseted bottom portion 20. Typical known techniques for formation of a gusset 20 may be utilized, such as a folding bar that folds the web of film 12 into a pair of opposing walls 16 and 18 while relatively simultaneously folding the bottom portion into a gusset 20, or including an air driven hole punch for formation of a "delta" style gusset for a stand-up feature.

The process line 10 can also have a strip unwind station for unwinding the semi-rigid material 22 from a roll of material 24, such that the strip 22 can be co-fed within the web of film 12. The strip unwind station may also include tension rollers (not shown) to control the unwind tension. Furthermore, the strip unwind station can also have a power unwind station for further control of the strip 22 as it is unwound. As the strip 22 is unwound, the semi-rigid strip material 22 can be positioned between the pair of opposing walls 16 and 18 of the web 12, such that the strip 22 is between the inner surfaces of the opposing walls 16 and 18. In one aspect, the strip 22 can be placed between the opposing walls 16 and 18, such that it is positioned about one inch from a top edge of the folded web of film 12, however, the strip 22 can be positioned at any desired distance from the top edge. It is preferable that the strip 22 is placed such that when the web of film 12 is formed, sealed and cut, that the strip 22 is positioned at relatively the uppermost portion of the finished package 100 after opening the package 100. Therefore, the semi-rigid strip 22 should be placed such that its uppermost edge ends at the location where the opening in the package 100 will be. The semi-rigid strip 22 is preferably adjacent a sealed opening of the final filled and sealed package 100 such that it can reinforce the opening and be used to provide a contoured rounded opening to assist in squeezing out the flowable material through the opening in conjunction with a back card attachment that can be squeezed to aid in dispensing the flowable material (to be described herein). In one aspect, when the package 100 is squeezed at an outer surface, the semi-rigid strip 22 can curl outward to provide a circular opening for better control of the dispensing of the flowable material.

Figure 2:
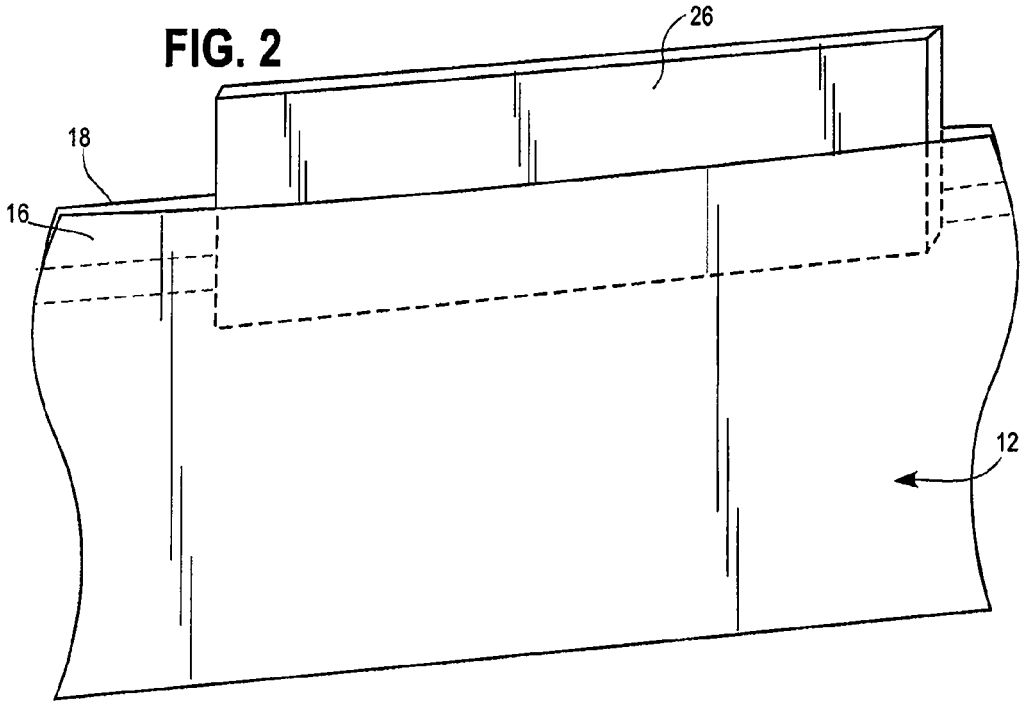
FIG. 2 is a perspective view of a portion of the process line of FIG. 1 where a metal buffer plate is shown positioned between opposing walls of the package prior to sealing one wall of the package to an inner semi-rigid strip.

To prevent sealing of one side of the strip 22 to one of the walls 16 or 18, a metal buffer plate 26, or divider plate or strip, can be positioned between the strip 22 and one of the opposing walls 16 or 18 of the web of film 12. The semi-rigid strip 22 can have two surfaces, a sealing surface and a non-sealing surface, however, either surface could be interchanged and the reverse could also be true. The non-sealing surface is the surface or side of the strip 22 that contacts the metal buffer plate 26 and can be determined by the positioning of the metal buffer plate 26. In one aspect, the metal buffer plate 26 can be placed between the front wall 16 of the web 12 and the strip 22, as shown in FIG. 2, thus making the side of the strip 22 that contacts the metal buffer plate 26, i.e., the side that is facing the front wall 16, the non-sealing surface of the strip 22. Therefore, the other side of the strip 22 becomes the sealing surface side and can be sealed to the back wall 18 of the film 12, since there is no metal buffer plate 26 between the back wall 18 and the strip 22. Furthermore, the height of the metal buffer plate 26 can be long enough to cover at least the strip 22, and can be slightly longer extending past the lower edge of the strip 22. The metal buffer plate 26 can be one contiguous piece, which can be relatively smooth. Alternatively, the opposite can be true where the metal buffer plate 26 can be inserted between the back wall 18 and the strip 22. Additionally, the metal buffer plate 26 can also be cooled so that the metal buffer plate 26 further prevents the web material 12 from sealing to the metal buffer plate 26 piece, thus allowing the web 12 to continue along in the machine direction. The metal buffer plate 26 can be cooled by blowing low temperature air, such as air between about 50 to about 60 degrees Fahrenheit along the surface of the metal buffer plate 26, such as by using a vortex generator to cool.

Next, the web of film 12 can advance towards a first sealing station where a sealing bar 28 for forming a seal between the sealing surface of the strip 22 and one of the opposing walls 16 or 18 is provided. In general, the seal can be formed between the opposing wall 16 or 18 and the side of the strip 22 which does not have the metal buffer plate 26 therebetween. In the aspect where the metal buffer plate 26 is placed between the front wall 16 and the strip 22, a seal can be formed substantially only between the back wall 18 and the strip 22 when the sealing bar 28 contacts the web of film 12. The sealing bar 28 can also include an opposing bar 27 relatively parallel to the sealing bar 28 against which the heated sealing bar 28 can press against when it is actuated in the direction of arrows B, moving towards the film 12. Furthermore, the opposing bar 27 is not heated and can further be provided as a cooled bar, such as being air cooled by blowing cool air into the opening where a heat probe would normally be. The first sealing station can comprise a sealing bar 28 that is relatively horizontal in form and relatively linear in shape to form a substantially horizontal seal across a top portion of the web of film 12 substantially between only one side of the strip 22 and only one wall 16 or 18 of the film 12. The seal typically formed is a heat seal, formed by the application of the heated sealing bar 28 to the web of film 12. The heat from the sealing bar 28 can melt together the web of film 12 to the semi-rigid strip material 22 inside, unless there is a barrier between the two, such as the metal buffer plate 26, a seal will be formed. The heated sealing bar 28 can be placed along a backside of the web of film 12 and the opposing bar 27 can be placed along a frontside of the web of film 12, such that in this aspect, the opposing bar 27 contacts the side of film 12 adjacent the metal buffer plate 26, or vice versa.

The heated sealing bar 28 can be placed on the process line 10 such that it is relatively parallel to the positioning of the strip 22. Therefore, where the strip 22 is placed inwards from the top edge of the web of film 12 about one inch, for example, the heated sealing bar 28 similarly would also be placed offset from the edge of film 12 about one inch. Additionally, any other distance can be used to offset the strip 22 from the edge of the web of film 12, however, the placement of the sealing bar 28 should generally be offset from the top edge of film 12 a similar distance as the strip 22. Due to the presence of the metal buffer plate 26, only one side of the strip 22 will seal to only one of the opposing walls 16 or 18. In the aspect where the metal buffer plate 26 is placed between the front wall 16 and the strip 22, substantially only the back wall 18 will seal to the strip 22. Thus, providing for a relatively unsealed area between the front wall 16 and the opposite side of the strip 22, which later can provide for an opening in the package 100. It should be noted, however, that although a portion of the front wall 16 remains unsealed to the strip 22, that it may eventually become sealed slightly at its edges thereof through later sealing steps, yet an unsealed area at least large enough to fill through will remain unsealed.

Additionally, the first sealing station can further include a pair of bottom gusset sealing bars 29 for use when a gusset 20 is previously formed in the web of film 12. The pair of bottom-gusset sealing bars 29 can be attached to the same actuating arm as the sealing bar 28 for the semi-rigid strip 22 such that the two sets of bars 28 and 29 can be activated at approximately the same time. The bottom-gusset sealing bars 29 can be positioned at relatively the bottom edge of the web of film 12 such that it seals only a side edge portion along the bottom edge of the gusset 20.

Figure 3:
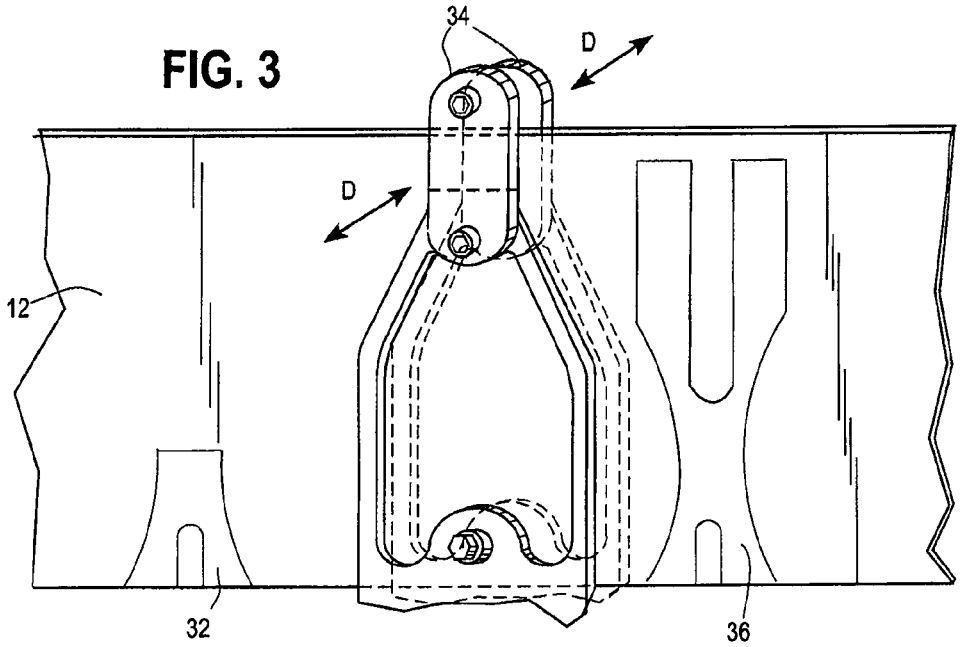
FIG. 3 is a perspective view of a portion of the process line of FIG. 1 where a third sealing station is illustrated, showing a non-linear shape of side seals formed prior to the third station and after passing through the third station.

Next, a second sealing station can be provided that can have a pair of sealing bars 30, a front bar **30*a* and a back bar 30*b*, such that one bar 30*a* can contact an outer surface of one of the opposing walls 16 and the other bar 30*b* can contact an outer surface of the other opposing wall 18 when the bars 30 come together upon actuation, as shown by arrows C. In one aspect, the front bar 30*a* may contact the outer surface of the front wall 16 and the back bar 30*b* may contact the outer surface of the back wall 18 of the web of film 12, such that upon contact a heat seal can be formed between the opposing walls 16 and 18 of the web of film 12. The sealing bars 30 of the second sealing station can be positioned to form a lower non-linear side seal 32 between the opposing walls 16 and 18 of the web of film 12 at spaced intervals, such that a set of two spaced, consecutive side seals 32 can define an area or pouch 101 within the web of film 12. In one aspect, the lower non-linear side seal 32 can be formed from the bottom edge of the web of film 12 and extend upwards about ⅓ of the height of the web of film 12. FIG. 3 shows an illustration of one embodiment of a shape for the lower non-linear side seal 32. The same lower non-linear side seal 32 can provide the side seal for two adjacent pouches 101 within the web of film 12. The lower non-linear side seal 32** can have a shape that can correlate to the shape of the first die-cut area, to be discussed herein.

A third sealing station can be provided to have a pair of sealing bars 34, similar to the pair of sealing bars 32 at the second sealing station except that the sealing bars 34 are shaped and positioned to form an upper non-linear side seal 36 between the opposing walls 16 and 18 of the web of film 12 at spaced intervals. The third sealing station can have sealing bars 34 having a different configuration and shape than the sealing bars 30 of the second sealing station. The pair of sealing bars 34 similarly contact the outer surfaces of the opposing walls 16 and 18 and form a heat seal upon activation in the direction of arrows D. After the formation of the upper non-linear side seals 36, all of the seals together can define a series of connected pouches 101 between the adjacent lower 32 and upper 36 side seals. In one aspect, the upper non-linear side seal 36 can be formed at least along the remaining ⅔ of the web of film 12, such that the upper non-linear side seal 36 can overlap a portion of the lower non-linear side seal 32 and can extend upwards to substantially the top edge of the web of film 12, as shown in FIG. 3. In another aspect, the side seal formed can extend from substantially the bottom of the web of film 12 and extend upwards to substantially the top edge of the web of film 12, such that the sealing bars 34 substantially overlap the entire area of the first side seal 32 formed for redundancy of the side seal strength.

Furthermore, the sealing bars 30 can be designed with a relief area therewithin to correlate to the width and thickness of the semi-rigid strip 22, such that the relief area allows for the strip 22 to move within the side sealing bars 30. This relief area allows the side sealing bars 30 to side seal a portion of the pouch 101 configuration and bottom gusset 20. Alternatively, the third sealing station can be optional, and only the second sealing station can be used to provide the entire side seal length that is desired. The third sealing station can be used when it is desired to make the side seal redundant, such as to reinforce the strength provided by the side seal.

After formation of the top and side seals, an optional cooling station can be provided for cooling the seals after sealing. The cooling station can comprise a pair of cooling bars 38 that can overlay the seal areas of the pouches 101, cooling the web of film 12 upon contact when the bars 38 are activated in the direction of arrows E. Any number of cooling stations can be provided, such that there can be a pair of cooling bars provided after each seal that is formed up to this point in the process. However, at least one cooling station with one pair of cooling bars 38 can be provided for the final heat seal that is formed, i.e., the heat seal formed between the opposing walls 16 and 18 at the upper non-linear sealed section 36. The cooling bars 38 are kept at a relatively cool temperature, such as by providing cooling water to flow through the bars 38 from a refrigerated water cooling unit set at about 42 degrees Fahrenheit, such that when the cooling bars 38 contact the heat seal formed between the web of film 12 it can cool down the seal area substantially upon contact. It can be preferable to cool all the heat seals formed, and at a minimum to at least cool the final side seal 36 formed, to about room temperature. The cooling bars 38 can be water-cooled or air-cooled. Cooling the heat seals can be advantageous when subsequently cutting the web of film 12 along its heat seals. Cutting through the heat seals at a cooled temperature, such as at about room temperature, can be easier than cutting the web of film 12 at an elevated temperature. When the web 12 is cooled to about room temperature, for example, the cut that results can be a cleaner and crisper cut, i.e., better defined cut edges, than with a hotter web of film 12 which can be soft and stick together upon cutting, for instance. In one aspect, the cooling bars 38 can be positioned vertically along the web of film 12 from its top edge to its bottom edge to cover substantially both side seals 32 and 36.

After the formation of the top and side seals, and optional cooling station if used, a first cutting station can be provided. The first cutting station can remove a portion of the lower side seal 32 and a portion of the upper side seal 36 that is adjacent to the lower side seal 32, while the remaining portion of the side seals 32 and 36 within the pouch 101 remain uncut and an upper portion of the side seals can remain attached to the web of film 12. The die-cutter 40 can essentially stamp or press out the desired cut shape into the web 12 upon activation in the direction of arrow F. In one aspect, the first cutting station can comprise a male/female precision punch or die mounted into machined blocks and driven by an air actuated pancake cylinder with zero backlash aircraft quality linear bearings that moves back and forth on a machined rail. The die-cutter 40 may not only cut or separate the sealed area of the pouch 101 from adjacent pouches 101, but it can also remove the cut piece or scrap such that a hole or gap is created between adjacent pouches 101 having a desired non-linear shaped cut that can define a portion of the outer shape of the package 100. The first die-cut can be formed from the bottom of the gusset 20, if one is present, upwards.

Figure 4:
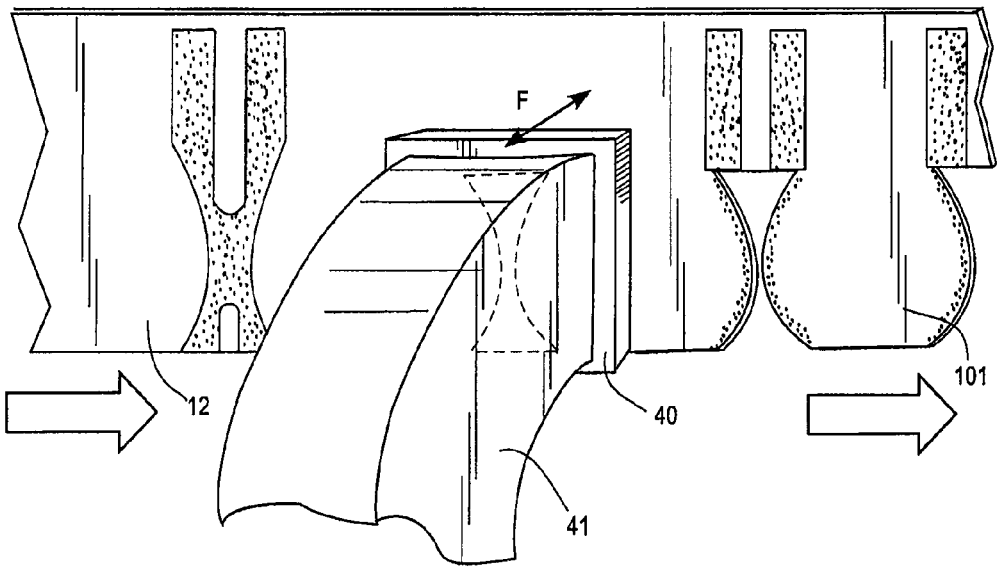
FIG. 4 is a perspective view of a portion of the process line of FIG. 1 where a first die-cutting station is illustrated, showing a non-linear cut formed and removed in a lower portion of the web of film.

The first cutting station can be positioned on the line 10 to cut the web of film 12 while it is in a relatively flat orientation, this can provide for an easier and more reproducible cut since the front wall 16 and the back wall 18 can be relatively flush with one another to make for a more uniform cut relatively simultaneously through both. The first cutting station can comprise a first die-cutter 40 that can be shaped to cut a non-linear area between two adjacent pouches 101. In one aspect, the first die-cut can result in a shape that is curved along the sides and linear along a small top section, such as is shown in FIG. 4, and where approximately the bottom two-thirds of the pouch 101 can be cut. Generally, a large enough area at the bottom of the pouch 101 should be cut such that the pouch 101 can be advanced in a machine direction (A) by using the bottom portion as an anchoring area in advancing the pouches 101, such as by attaching a clamp along a chain drive to the bottom portion, or other conveying assembly. A clamp can be used where the pouches are small, such that the clamp height can allow for clearance of the top sealing bars 54 and 56. Additionally, a vacuum chute 41, or other type of removal system, may be provided adjacent the die-cutter 40 to remove the scraps that are cut away from the web of film 12 and to blow the scraps into the chute 41 for removal.

Next, a separating station can be provided having a knife 42, shear or other cutting element positioned to separate the connected pouches 101 into separate individual pouches 102. The knife 42 can singulate the pouches 101 by providing a relatively vertical and linear cut between the connected upper portion to separate the pouches 101 in the direction of arrow G. In one aspect, the upper portion can be at least about the same width as the bottom portion of the pouch 101 (i.e., the widest section of the bottom of the pouch 101), such that the wider upper portion can provide added strength upon filling the pouch 102 due to the greater width in the upper portion for support. After the pouches 101 are separated, they can be advanced along the line 10 using any known methods, such as by attaching the individual pouches 102 to clips or clamps 44 of a chain drive along at least one side of the pouch 102, which can advance the separated individual pouches 102 in a machine direction. In another aspect, a feed roller system can be provided, prior to the separating station, designed for the specific pouch design herein to feed the web of connected pouches towards a separate knife assembly that vertically cuts and separates the pouches into individual units while relatively simultaneously advancing the separated pouches into a cam opened clamp (as mentioned above) attached to an indexing chain. Alternatively, the connected pouches 101 can be filled and/or sealed closed before separating.

Next, an optional gas flush station may be provided for flushing the interior section of the pouch 102 either prior to filling or relatively simultaneously to filling or both. In one aspect, the pouch 102 can be flushed with gas to blow open the pouches 102 in anticipation of filling. The gas flush helps to expand or separate the opposing walls 16 and 18 from one another just wide enough to assist in a more productive filling step. The gas flush can comprise either air or nitrogen, for example. Additionally, where the interior section of the pouch 102 cannot contain air, i.e., oxygen, such as where the pouch 102 is being filled with a substance that reacts with air, the gas flush can be provided to aid in dissipating air from the interior of the pouch 102 and can comprise a gas such as nitrogen. In one aspect, the process line 10 can contain a splitter bar 46 across the top of the process line 10, positioned between the opposing walls 16 and 18 of the pouch 102 at its top edge of the film 12 to slightly hold apart the opposing walls 16 and 18. The splitter bar 46 can be located along the line 10 throughout substantially the entire process up to location of an air knife 45 at the gas flush station. The gas flush can be provided through the air knife 45 that can have small openings or gaps that allow for passage of gas therethrough and into the interior section of the pouch 102. The air knife 45 can be positioned in the interior of the pouch 102, between the front 16 and back 18 walls of the pouch 102, and as the pouch 102 is passed under the gas flush station, the gas is blown through the air knife 45 into the pouch 102.

A filling station can be provided next, such that the filling station can have a reciprocally moveable filling tube or nozzle 50 insertable into the individual pouches 102 through an opening 64 in the pouch 102 for filling the pouch 102 with a flowable material. In one aspect, the filling apparatus can comprise a positive displacement pump having a reciprocating piston and cylinder assembly, coupled to the nozzle for filling. In another aspect, the filling mechanism can be servo-driven with a separate PLC controller which activates a specially designed diffuser nozzle to prevent stringing of the product when the cut off occurs downward to provide a precise amount of the product fill as the nozzle travels upward at a precise speed. The moveable filling tube 50 can be plunged into the pouch 102 in the direction of arrow N to a certain depth before filling or as filling is begun and, for example, the nozzle 50 can be inserted at relatively the bottom of the pouch 102 and can simultaneously move up as the material is being dispensed into the pouch 102. As the pouch 102 is being filled, a gas can also simultaneously or relatively simultaneously be inserted through the opening 64. The filling station can comprise any typical filling station that can provide the desired result, such as a ProSys LVF-M1 Fill Station, manufactured by ProSys Innovative Packaging Equipment located in Webb City, Mo. Additionally, the filling station can include a pair of vacuum suction cups 48 or other similar device for holding open the top edge of the pouch 102, such as grippers and the like. The suction cups 48 can be applied to the package walls 16 and 18 in the direction of arrows H, one on each opposing wall 16 and 18 of the pouch 102 at their outer surfaces, to hold open the pouch 102 while filling through the opening 64 in the interior of the pouch 102. Alternatively, more than one suction cup can be used per wall. Additionally, a bottom plate (not shown) may be provided to guide the bottom portion of the pouch 102 and can hold the pouch gusset 20 to a prescribed opening. Furthermore, these can act in concert with the vacuum suction cups 48 used to hold open the pouch 102. All of these features together can assist in maintaining the pouch 102 in an upright position in the clips 44, such that the pouch 102 can remain in a relatively perpendicular alignment to the filling nozzle station and can allow for proper nozzle 50 insertion and filling.

Optionally, a deflating station can also be provided downstream of the filling station where a deflator bar, or a pair of deflator bars 52, can be used to press against the filled pouch 102 and each other to apply a slight pressure to the top edge of the filled pouch 102, such as to squeeze the walls 16 and 18 of the pouch 102 inwards. The deflator bars 52 can function to exert a controlled flattening of the upper portion of the pouch 102 where it is not filled with the flowable material to further prepare the upper portion of the pouch 102 for sealing and subsequent cutting. The deflator bars 52 can also force out any air or other gases from the top portion of the pouch prior to sealing. In one aspect, the deflator bars 52 can be a sponge-like material or other soft material having a rectangular shape and coming together towards the pouch 102 upon actuation in the direction of arrows I.

Next, a fourth sealing station can be provided having a pair of sealing bars 54 positioned to form a top seal between both opposing walls 16 and 18 in the pouch 102 to close the opening 64 thereat. In one aspect, the sealing bars 54 can be a pair of horizontal sealing bars that form a relatively linear seal across the top portion of the pouch 102 upon actuation in the direction of arrows J. It is preferable that the sealing bars 54 are positioned such that they are relatively above the semi-rigid strip 22 such that the bars 54 do not contact the strip 22, so that application of these sealing bars 54 to the pouch 102 does not seal the semi-rigid strip 22 to the opposing wall 16 or 18 where it is unsealed.

Optionally, a fifth sealing station can also be provided having a pair of sealing bars 56 positioned to form a second top seal in the pouch 102 or to form a redundant top seal upon actuation of the bars 56 in the direction of arrows K. The redundancy in the sealing can help to strengthen the seal area; however, a similar strengthening can be achieved by using a single sealing step and by increasing the temperature of the sealing bars and/or the dwell time, i.e., contact time, of the bars with the film 12. The fifth sealing station may also consist of a pair of horizontal sealing bars that form a relatively linear seal across the top portion of the pouch 102. In one aspect, where there are two relatively consecutive top seals formed, as with the fourth and fifth sealing stations, the fourth sealing station can provide a lower top seal, and the fifth sealing station can provide an upper top seal that is closer to the top edge of the pouch 102 than the seal made with the fourth sealing station. There may also be some overlap of the sealing regions of the top seals at the fourth sealing station and the fifth sealing station.

Furthermore, there may be an optional cooling station positioned downstream of the fourth and/or fifth sealing stations. The cooling station downstream of the fourth and/or fifth sealing stations may comprise at least a pair of cooling bars 58 positioned near the top seal area to cool the heat seal upon application of the cooling bars 58 in the direction of arrows L. The temperature settings may be similar to that of the previous cooling station.

Figure 5:
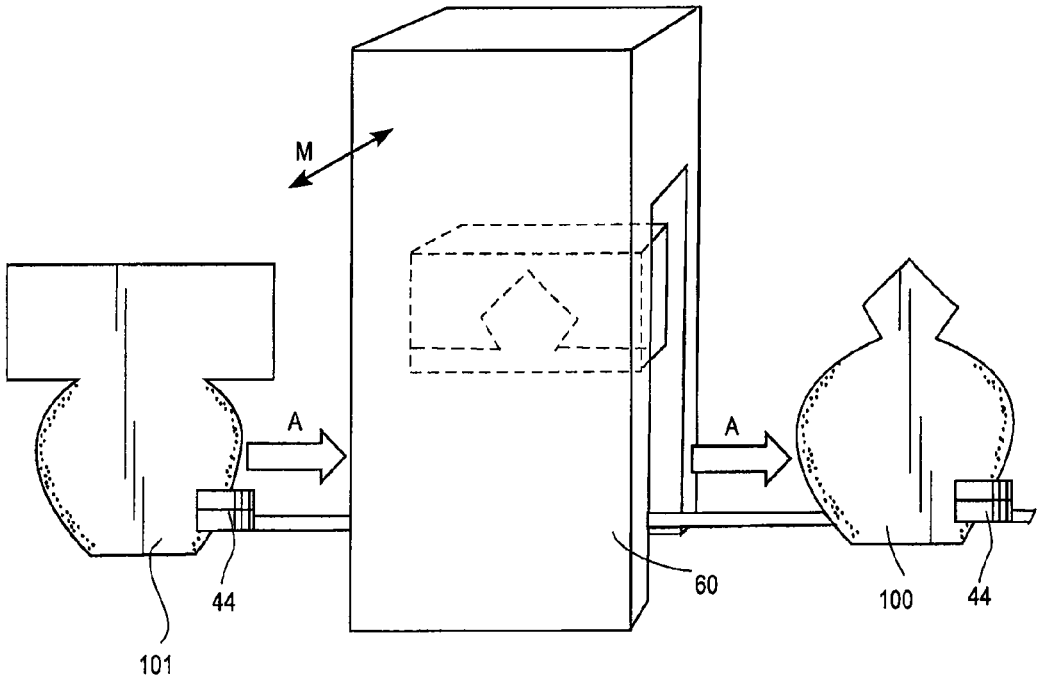
FIG. 5 is a perspective view of a portion of the process line of FIG. 1 where a second die-cutting station is illustrated, showing a non-linear cut formed and removed in an upper portion of a filled and sealed package.

Finally, a second cutting station can be provided to remove a portion of the top seal and can also provide a chute for removal of waste scrap material. This second cutting station comprises a second die-cutter 60 that can have a non-linear die shape, and preferably, a non-linear shape for cutting out a portion of the top seal such that a relatively curved or triangular or diamond-shaped upper portion results, or any other non-standard shape. In one aspect, the second die-cutter 60 can cut approximately the remaining ⅓ of the package 102, such that the upper portion comprises the remaining ⅓. The second die-cutter 60 can stamp out a piece of film material 12 out of the sealed package upon actuation of the die-cutter 60 in the direction of arrow M. Typically, most die-cuts on conventional processes are performed prior to filling steps so that the web material is in a relatively flattened state for cutting or are simple "separation" cuts to separate packages, whereas the second die-cutting step herein can occur after filling and is a true die-cut that stamps out a shape within the sealed package. The second die-cutter 60 can remove a portion of the top sealed region to form a narrowed neck adjacent the closed and reinforced opening in the package 100, such as is shown in FIG. 5. This narrowed neck is such that the remainder of the package 100 tapers towards the sealed opening. Once the final cut has been made, the finished pouches 100 can be removed from the line 10 by any means, such as a vacuum assembly, and placed onto a moving conveyor. This method allows for manufacture of a package 100 having a narrowed upper portion or neck with a wider bottom, without the typical horizontal and vertical seals usually found on most flexible pouches. Furthermore, the two-stage sealing and cutting process can allow for the flexible packages 100 herein to be produced on a single in-line apparatus 10, such as a horizontal or a vertical form, fill, and seal packaging machine.

Figure 7:
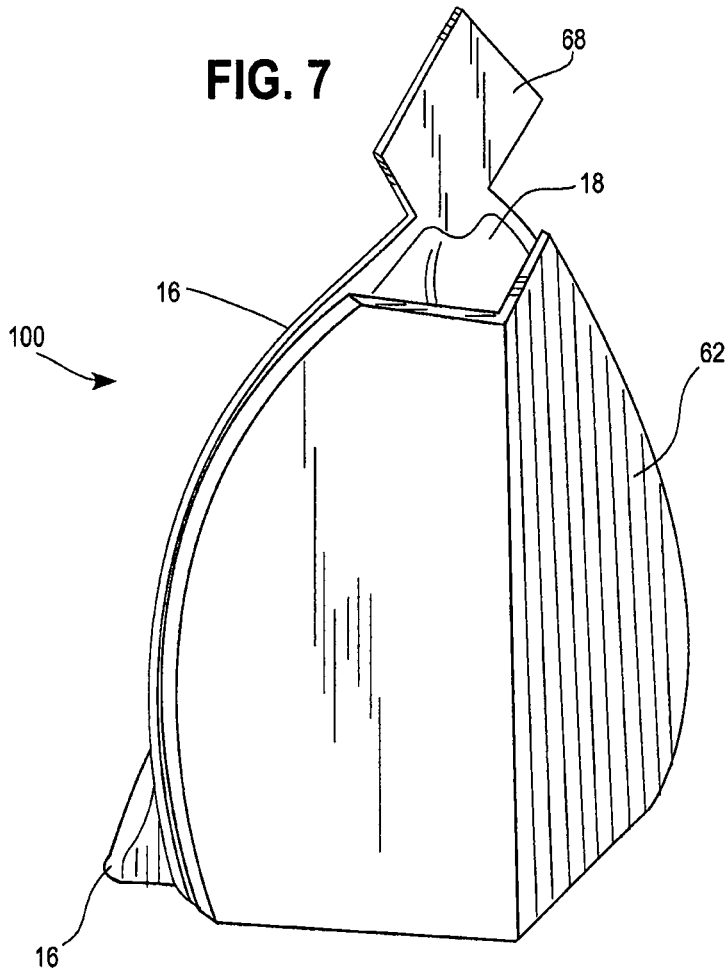
FIG. 7 is a back perspective view of a package manufactured using the method shown in FIG. 1.
Figure 8:
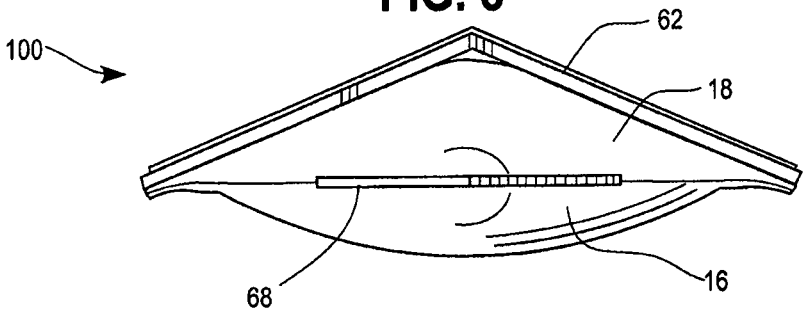
FIG. 8 is a top end perspective view of the package shown in FIG. 7.

Optionally, a back card attaching station can also be provided to attach a back card 62 or panel to the outer surface of one of the opposing walls 16 or 18. The step of attaching the back card 62 to the flexible package 100 can include folding the back card 62 and attaching it to one of the opposing walls 16 or 18 of the pouch 100 to bow the semi-rigid strip 22 inside to define an arcuate outlet adjacent the opening. The back card 62 further can provide additional information or graphics for the package 100 as well as being functional. The back card 62 can also be slightly angled down the middle of the back card 62, along its length, as shown in FIG. 7. The slight angle of the back card 62 keeps the back surface of the opposing wall 16 or 18 to which it is affixed at a slight angle of protrusion as well, rather than providing a flat surface for that opposing wall 16 or 18, as can be seen in FIG. 8. Furthermore, the angled back card 62 can assist in keeping the semi-rigid strip 22 rounded or bowed such that the opening therein remains open, rather than the semi-rigid strip 22 being held flat and thus keeping the opening in a closed position. When the package 100 is opened and it is desired to dispense some or all of the flowable material therein, the back card 62 can further provide a squeezing mechanism to assist in removing the material from the narrow opening in the top. The back card 62 can be attached using a pressure sensitive adhesive material, such as MACbond IB-1690 or a similar pressure sensitive adhesive. In another aspect a patterned hot melt adhesive can be placed on the back of the package 100 or back card 62 or both. In one aspect, the back card 62 can be attached to the outer surface of the back wall 18. The back card material can comprise any sturdy and durable material typically used, such as a rigid plastic, fiberboard, cardboard, paperboard, or corrugated board material. In another aspect, the angle provided in the back card 62 can be such that it is about 45 degrees or less and the back card material is an E-flute corrugated material.

The process line 10 may further include optional guide monitors, such as travel guide arms or guide eyes (not shown). Travel guide arms can comprise guide wires, for example, that can direct the web of film 12 along the process line 10 and keep it from getting out of alignment. In one aspect, the travel guides can be used to direct the die-cut web material into a feed roller system (not shown) prior to separation into individual pouches 102. The feed roller system can be provided to accommodate different pouch side thicknesses (i.e., the pouch can have a thicker area along its side where the semi-rigid strip is located as compared to a lower section of the pouch) and moves the die-cut web material into the knife/shear assembly.

Guide eyes, or electronic eyes, can also be used and can comprise a laser pointer or other type of optical reader that registers when the pouch, strip, or whatever item it is to be monitoring, runs out or is not present thus reacting to the missing item by shutting down the machine, for instance. The electronic eyes can be used to monitor when a material runs out and needs to be replenished, thus stopping the process until it can be replaced, or when there is a malfunction in a step of the process. The electronic eye can then send an output to an electronic element of the apparatus, which can then react to the situation. In one aspect, an electronic eye can monitor the roll 24 of semi-rigid strip 22 to ensure that each pouch contains a semi-rigid strip 22. When the strip 22 runs out, such as when a roll needs to be replaced, the electronic eye can signal to the apparatus or machine to stop the process until the strip 22 is replaced. In another aspect, the electronic eye can provide side to side pouch registration as it moves through the machine to verify that the pouch is properly aligned. In still another aspect, the electronic eye can be located at the filling station to read and register the presence of a pouch, such that the filling station only dispenses material when a pouch is present to receive it. If no pouch is present, then the line can stop so that the filling station is not activated thus preventing spillage of material.

A further optional station can comprise a chilling station, such as a vortex cooler or chiller apparatus. The chiller apparatus can be used at cooling stations in place of or in addition to cooling bars. Furthermore, an optional printing station can be supplied anywhere on the process line 10 to imprint small text or codes, such as "use by" dates or batch codes. In one aspect, the printing station can be located substantially immediately after the folding station, but before the first sealing station, where it can imprint text while the web of film is in a flat orientation, easier for printing.

Another optional step can be to apply a score line or tear line to the top portion of the package, adjacent the sealed and reinforced opening, where a tear-off tab 68 or flap of the package can be located. This can provide for a tear region where the user can pull off the top of the package along this line or area for an easier opening. Likewise, a tear region can be provided in the package without a score line or other tear initiation feature. In another aspect, a notch or slit can be made to the left and/or right vertically sealed side edge, such as by an air activated punch, adjacent to the tear line to assist in the tearing of the package opening. A further optional step can be to apply a peggable display hole in an upper portion of the package, such as within the tear off tab 68 or flap region.

The process line parameters may be chosen such that they result in the desired package 100. In one aspect, the process line speed may be set at about 36 pouches per minute. In that aspect, the temperature of the sealing bars may range between about 275 and about 330 degrees Fahrenheit, depending upon the sealing bar location in the process. For example, at the first sealing station, the sealing bar 28 for sealing the semi-rigid strip 22 can be set to a temperature of approximately 305 to about 330 degrees Fahrenheit. Similarly, the gusset/bottom sealing bars 29 can be set at a temperature of about 275 degrees to about 300 degrees Fahrenheit. At the second and third sealing stations, the side sealing bars 30 and 34 can be set at temperatures between about 300 and 305 degrees Fahrenheit. At the fourth and fifth sealing stations, the top sealing bars 54 and 56 can be set at temperatures between about 290 and 310 degrees Fahrenheit. As the indexing speed increases, i.e., the line speed increases, the temperatures can change to compensate for the shorter sealing dwell time or contact time of the sealing bars with the film 12, such as by increasing the temperatures. The temperature of the cooling bars 38 and 58 can be about 111 degrees Fahrenheit.

Figure 6:
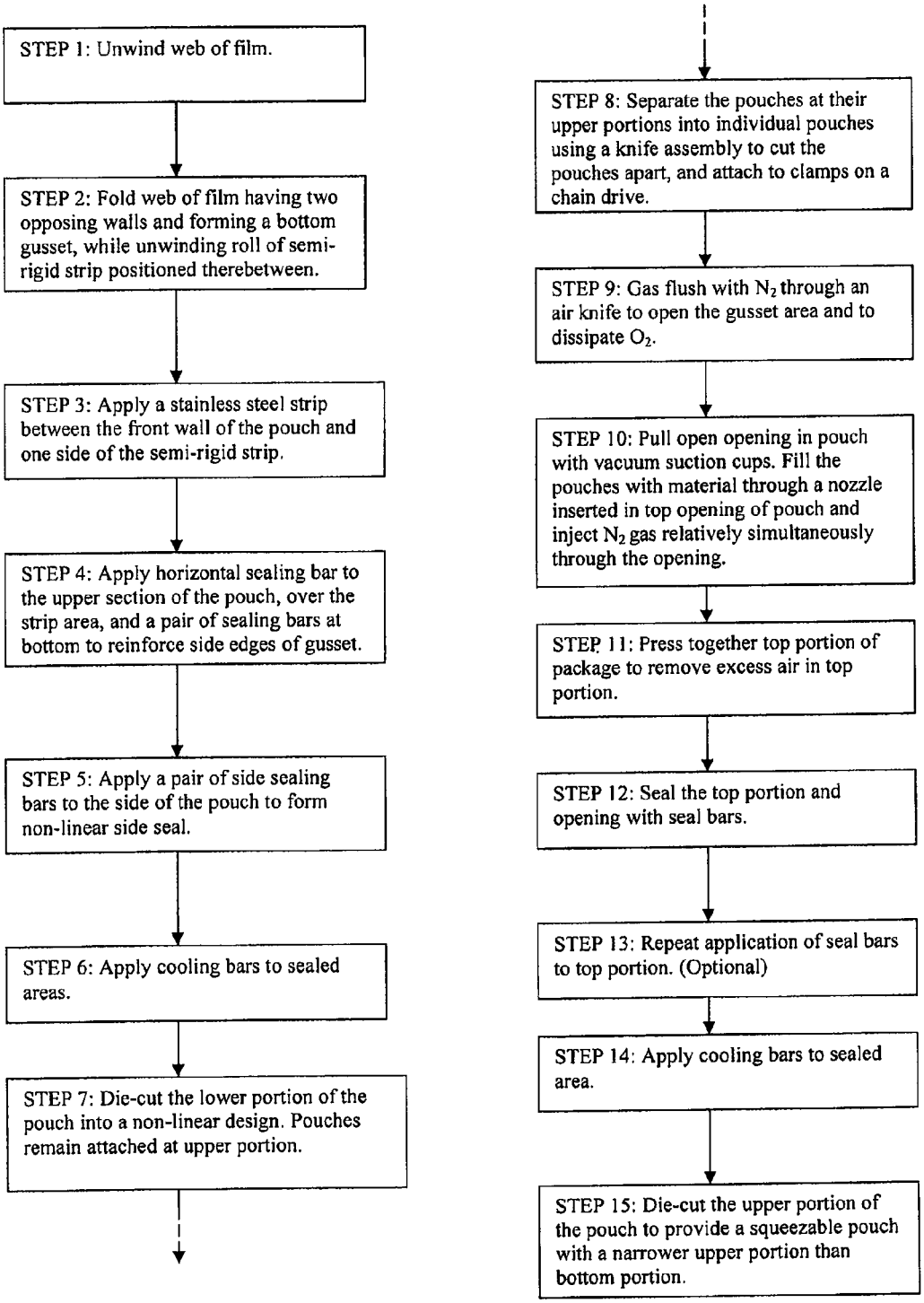
FIG. 6 is a flow chart of one embodiment of a method of manufacturing a flexible package having dual-stage die-cutting and application of an interior semi-rigid strip that is sealed to one wall of the package but not the other.

Turning to FIG. 6, a schematic flow chart 200 is shown of one embodiment of the method of manufacturing the flexible packages 100. At Step 1, the web of film is unwound and directed in a machine direction. Step 2 provides for the web of film being folded along a folding bar 66 to result in a pair of opposing walls, a front wall 16 and a back wall 18, with a bottom gusset 20 formed therein. A semi-rigid strip material 22, such as a high-density polyethylene ("HDPE") strip, can also be unwound from a roll 24 of material and positioned between the opposing walls 16 and 18 of the folded web of film 12. At Step 3, the metal buffer plate 26, which can comprise a stainless steel strip in this embodiment, can be placed between the front wall 16 and the strip 22, such that one side of the strip 22 contacts the metal buffer plate 26 while the opposite side does not.

Step 4 provides for application of a horizontal sealing bar 28 to the upper section of the web of film 12 such that the bar 28 can be relatively parallel to the strip 22 position in order to attach the strip 22 to one of the opposing walls 16 or 18. The application of this sealing bar 28 can form a heat seal on the opposite side of the strip 22 between the strip 22 and the back wall 18 in this embodiment, for example, while the other side of the strip 22 contacting the metal buffer plate 26 remains relatively unsealed to the front wall 16. Additionally, a pair of lower bars 29 can be provided to seal the bottom side edges of the gusset 20. Step 5 provides for sealing the opposing walls 16 and 18 of the web of film 12 together through application of at least one pair of side sealing bars 30 and, optionally, a consecutive pair of side sealing bars 34, with each set forming a relatively non-linear side seal 32 and 36 spaced apart at an interval to provide spaced sealing regions to form a series of adjacent pouches 101 in the web 12 between the sealing regions. Followed by the side seal formation, application of a pair of cooling bars 38 to the side seal region is shown at Step 6 to cool down the heat sealed area in order to prepare the region for cutting.

Step 7 provides for the first die-cut 40 to the web of film 12 to remove a section of the sealing regions and to provide multiple pouches 101 connected at an upper portion. The first die-cut 40 can be applied generally to the lower portion of the pouch 101, such that it cuts and removes a portion of the side seals 32 and 36 thereat. The die-cut 40 can be a relatively non-linear cut such that the lower portion of the pouch results in a curved or tapered shape. At Step 8, the pouches 101 connected at the upper portions are separated into individual pouches 102. The pouches 101 can be separated by using a knife 42 or other cutting device and can then be attached to a clamp 44 of an indexing chain drive. A feed roller system can be used to advance the web of connected pouches towards the knife assembly and towards the clamp assembly for advancing the packages along the indexing chain. Followed by the separation step, the pouches 102 can be flushed with a gas in the interior section of the pouch through use of an air knife 46, either prior to filling, relatively simultaneously with filling, or both, as shown at Step 9. The gas flush step helps to blow open the package 102 slightly and, where nitrogen gas is used as in this embodiment, it can substantially dissipate the oxygen in the interior section of the pouch 102.

At Step 10, the opening 64 of the pouch can be pulled open with either single or double vacuum suction cups 48 positioned on each side of the web of film 12 to keep the opening 64 open for insertion of the filling nozzle 50. The interior section of the pouches are then filled with a flowable material through an opening 64 in the upper portion of the pouch 102. A nozzle 50 can be inserted through the opening 64 and, if desired, a gas, such as nitrogen, can be injected relatively simultaneously therewith. At step 11 a deflation step can be provided to release some of the air from the top portion of the pouch 102. A pair of deflator bars 52 can be used that press against the top portion relatively simultaneously to deflate and flatten part of the top portion of the pouch 102. At Step 12, the top seal in the pouch 102 is formed to close the opening in the pouch 102. At Step 13, a second top seal can optionally be formed to strengthen the sealed area. The top seals are typically formed above the strip 22 so that the strip 22 does not accidentally become sealed to the web of film 12 through this process. The application of dual heat seals to the top seal area helps to reinforce the seals made. Alternatively, higher temperature heat sealing bars can be used as well as a longer dwell time of the sealing bars on the web of film 12 during formation of the heat seals in order to reinforce the seals.

At Step 14, a set of cooling bars 58 can be employed to cool the heat sealed area of the top seal in order to prepare the region for cutting. The cooler web material can be cut more cleanly and more precisely when it is cooler than when it is hotter due to the web material being stiffer when it is cool, rather than slightly malleable and soft after heating. The stiffer the material, the easier it becomes to cut the precise shape desired. At Step 15, the second, and final, die-cut 60 is provided to remove a portion of the top sealed region. The final cut 60 results in a tapered pouch 100 having a narrower upper portion than bottom portion.

A flowable material can comprise any material that can "flow" or roll upon itself, such as a solid, semi-solid, gaseous, semi-liquid, or liquid material, and can be either a food or non-food material. In one aspect, a synthetic material with a relatively low viscosity may be used, such as a caulk material comprising either a silicone or acrylic-based material. Some consumer product materials that can be filled into the pouches 102 can comprise cosmetics, creams, lotions, shampoo, oil, mouthwash, and the like. In another aspect, a food material may be used such as a liquid drink or semi-liquid ketchup or other condiment. Some food products that can be filled into the pouches can comprise ketchup, vinegar, mustard, relish, honey, butter, cream sauces, juices, drinks, puddings, and the like.

The materials of construction of the web of film 12 can be any commonly used flexible packaging material and, in particular, a flexible packaging material that allows for the user to squeeze the outer surface of the package 100 to push out the contents therein. In one aspect, the web of film 12 may comprise single layer, multi-layer, or laminated films. The web of film 12 may include at least one component material comprising nylon, foil, polyester, linear low density polyethylene, and the like. In one aspect, a laminated web of film 12 can comprise biaxially oriented nylon laminated to a foil, which has been laminated with polyester and has been further laminated to a linear low density polyethylene (such as a 3.5 mil film). The biaxially oriented nylon can also be reverse printed with an indicia. When the multiple layers of film material are laminated they can be laminated with a chemical resistant adhesive. Additionally, the polyester laminated film can be treated with aluminum oxide for improved moisture vapor transmission properties.

The semi-rigid strip material 22 can be a plastic or other type of material that can heat seal to the web of film 12 used. For example, semi-rigid strips 22 may comprise a single layer of film, multiple layers or co-extruded layers. The semi-rigid strip 22 may comprise materials made from a high-density polyethylene (HDPE), a linear low density polyethylene (LLDPE), metalicine, and combinations thereof. For example, in one aspect, the semi-rigid strip 22 used may be an HDPE strip which is essentially a co-extrusion of about 60% HDPE and about 40% LLDPE/metalicine as the outer layer. The LLDPE/metalicine outer layer can more easily seal to the opposing wall 16 or 18 of the web of film 12, where the laminated web of film 12 can also comprise an outer layer of LLDPE. The HDPE strip 22 having the outer layer of LLDPE/metalicine can seal to the outer layer of the web of film 12, i.e., the LLDPE layer, by bleeding outward as the seal occurs, which can compensate for the HDPE strip 22 being canted upward or downward because of the pouch position with the HDPE edges tending to hold off the sealing bars. In another aspect, the semi-rigid strip 22 can be co-extruded with polypropylene/LLDPE/metalicine layers.

The metal buffer plate 26 that is used may be a stainless steel strip, or other type of insulating metal. In addition, the metal buffer plate 26 may further be coated with another metal compound, such as a nickelon coating, e.g., a combination of nickel and teflon, for a smooth and durable outer surface. Furthermore, it may be desired to provide a printing indicia or label on the outer surface of the web of film 12. This can be done before, during or after formation of the package 100. Preferably, the roll of film 14 is pre-printed with the desired graphics or indicia thereon.

The package 100 that results from this process 10 can have any shape that is non-linear and non-traditional; i.e., not rectilinear in form. Typically, the packages 100 that can result from this process can have a narrowed neck adjacent the closed and reinforced opening near the top portion of the package 100 with a wider and tapered bottom portion. The package 100 can taper towards the reinforced opening, such that the bottom portion of the package 100 can have a relatively triangular, curved or other tapered shape. The final form of the package 100 is such that the narrowed neck, if cut into the web of film 12 prior to filling, would make the top opening of the package too flimsy such that it would sag and would be too small through which to fill. A package that is filled through the smaller opening of the finished package would be very unsturdy and most likely could not be automated on-line easily. Therefore, the top portion of the package 100 should remain relatively uncut, and relatively wide, i.e., about as wide as the bottom portion of the package, such that the opening of the package is wider than in its final form and is therefore sturdier during filling through the wider opening. The opening of the unfilled package should be at least as wide as the filling nozzle 50 that is inserted therein. Furthermore, the top portion of the package 100 can have a tab extending above the sealed opening which can be torn off or otherwise removed to reveal the opening therein.

After filling, and after the final seal and die-cut, the final package 100 can have any shape that is non-rectilinear and with a narrower upper portion than bottom portion, such as a tear drop or bulbous shape, for example. For example, in one aspect the final package 100 can have dimensions such as a height between about 3 to 7 inches, and a width that varies along its height from about 0.2 inches to about 5 inches, where the smallest width is typically near the top opening of the package 100. In one aspect, the final package 100 can have a fillable interior volume of approximately 1.25 fluid ounces. In that aspect, the package 100 can be about 5 inches high, about 3 inches wide at its widest area along the bottom portion, and about 0.5 inches wide adjacent the sealed top opening. The package 100 can further have an opening sized about 0.20 inches, in that same aspect. The web of film 12 utilized to manufacture the package 100 can be any width, and in one aspect can have a width between about 5 and about 30 inches. In another aspect, the web of film 12 can have a width of about 12 inches. The semi-rigid strip 22 that can be inserted between the opposing walls 16 and 18 of the web of film 12 can likewise be sized at any width that is necessary for placement about the opening, and to allow for a rounded and reinforced opening, and will not exceed the height of the final package 100. In one aspect, the width of the semi-rigid strip 22 can be between about ¼ inch and about 3 inches. In another aspect, the width of the semi-rigid strip 22 can be about 1 inch, or about 63/64 of an inch. Additionally, the semi-rigid strip 22 can have a thickness of about 14 to about 15 mil.

From the foregoing, it will be appreciated a method of manufacturing a non-rectilinear flexible package, and apparatus for such method, is provided such that numerous modifications and variations could be made thereto by those skilled in the art without departing from the scope of the method and apparatus as set forth in the claims. Therefore, the disclosure is not limited to the aspects and embodiments described hereinabove, or to any particular embodiments. Various modifications to the method of manufacturing the non-rectilinear flexible package, and apparatus therefore, can be made.

What is claimed is:

1. A method of forming and filling a flexible package using an in-line process, the method comprising:
- directing a web of film and a semi-rigid strip in a machine direction;
- folding the web of film to have a pair of opposing walls with the semi-rigid strip therebetween;
- attaching the strip to one of the opposing walls;
- sealing the opposing walls of the web of film together at spaced sealing regions to form pouches between the sealing regions;
- separating the connected pouches from the web of film to provide an individual pouch;
- filling an interior section of the individual pouch through an opening in the upper portion of the pouch with a flowable material;
- forming a top sealed region closing the opening in the pouch; and removing a portion of the top sealed region to form a narrowed neck adjacent the closed opening.

2. The method of claim 1, further including the step of inserting a metal buffer between the semi-rigid strip and an opposite wall from the one of the opposing walls prior to the step of attaching the strip to the one of the opposing walls.

3. The method of claim 1, wherein the flowable material is caulk.

4. The method of claim 1, further including the step of attaching a back card to the flexible package.

5. The method of claim 4, wherein the step of attaching the back card to the flexible package further includes the step of folding the back card and attaching the back card to the one of the opposing walls to bow the semi-rigid strip to define an arcuate outlet adjacent the opening.

6. The method of claim 1, wherein the step of sealing the opposing walls together includes forming an initial sealing region opposite the semi-rigid strip and then forming the remainder of the sealing region.

7. A method of forming and filling a squeezable package, the method comprising:
- directing a web of flexible film and a semi-rigid strip in a machine direction;
- folding the web of film into a pair of opposing package walls having a front wall and a back wall and positioning the strip between the front and back wall;
- inserting a metal buffer plate between one of the front wall and the back wall and the strip;
- sealing the strip to the other of the front wall and the back wall and restricting sealing to the one of the front wall and the back wall using the metal buffer plate;
- forming a lower non-linear side seal between the opposing walls in the web of flexible film;

forming an upper non-linear side seal between the opposing walls in the web of flexible film partially coextensive with the lower side seal;

separating the connected pouches from the web of film at the upper portion to provide an individual pouch;

filling an interior section of the individual pouch through an opening in the upper portion of the pouch with a flowable material; and forming a top seal to close the opening.

8. An apparatus for forming and filling a flexible package, the apparatus comprising:

a film unwind station for unwinding a web of flexible film from a roll of film;

a folding station for folding the web into a pair of opposing walls;

a strip unwind station for unwinding a strip of semi-rigid material from a roll of material and positioning the strip between the pair of opposing walls of the web;

a metal buffer plate insertable between the strip and one of the opposing walls of the web;

a first sealing station having a sealing bar for forming a seal between the strip and the other of the opposing walls;

a second sealing station having a pair of sealing bars positioned to form a lower non-linear side seal between the opposing walls of the web of flexible film at spaced intervals;

a third sealing station having a pair of sealing bars positioned to form an upper non-linear side seal between the opposing walls of the web of flexible film at spaced intervals to define connected pouches between adjacent lower and upper side seals;

a separating station having a knife positioned to separate the connected pouches into separate individual pouches;

a filling station having a reciprocally moveable filling tube insertable into the individual pouches through an opening in the pouch for filling the pouch with a flowable material; and a fourth sealing station having a pair of sealing bars positioned to form a top seal in the pouch to close the opening.

9. The apparatus of claim 8, further including a fifth sealing station having a pair of sealing bars positioned to form a second top seal in the pouch.

10. The apparatus of claim 8, further including a cooling station for cooling the seals after the sealing stations.

11. The apparatus of claim 8, further including a gas flush station for flushing the interior section of the pouch either prior to filling or relatively simultaneously with filling or both.

12. The apparatus of claim 8, wherein the filling station includes a pair of vacuum suction cups for separating the opening in the pouch before filling.

* * * * *